US011452358B2

(12) United States Patent
Carraro

(10) Patent No.: US 11,452,358 B2
(45) Date of Patent: Sep. 27, 2022

(54) CASE FOR COSMETIC PRODUCTS

(71) Applicant: ALBEA SERVICES, Gennevilliers (FR)

(72) Inventor: Daniel Carraro, Asnières sur Seine (FR)

(73) Assignee: Albea Services, Gennevilliers (FR)

( * ) Notice: Subject to any disclaimer, the term of this patent is extended or adjusted under 35 U.S.C. 154(b) by 459 days.

(21) Appl. No.: 16/050,490

(22) Filed: Jul. 31, 2018

(65) Prior Publication Data

US 2019/0029400 A1 Jan. 31, 2019

(30) Foreign Application Priority Data

Jul. 31, 2017 (FR) ..... 1757324

(51) Int. Cl.
*A45D 40/22* (2006.01)
*A45D 33/24* (2006.01)
*A45D 33/00* (2006.01)

(52) U.S. Cl.
CPC ..... *A45D 40/222* (2013.01); *A45D 33/008* (2013.01); *A45D 33/24* (2013.01); *A45D 2040/223* (2013.01); *A45D 2040/225* (2013.01); *A45D 2200/051* (2013.01)

(58) Field of Classification Search
CPC .... A45D 40/222; A45D 33/24; A45D 33/008; A45D 2040/225; A45D 2200/051; A45D 2040/223
USPC ..... 206/581
See application file for complete search history.

(56) References Cited

U.S. PATENT DOCUMENTS 5,875,795 A * 3/1999 Bouix ..... A45C 11/22 132/293
7,604,142 B2 * 10/2009 Banik ..... A45D 40/221 220/250
8,043,017 B2 * 10/2011 Beierwaltes ..... A45D 40/24 401/17
10,973,301 B2 * 4/2021 Crapet ..... A45D 40/00
2007/0181575 A1 8/2007 Yamanaka
2008/0011320 A1 * 1/2008 Bouix ..... A45D 33/006 132/293
2012/0305442 A1 * 12/2012 Apodaca ..... A45D 33/006 206/581

(Continued)

FOREIGN PATENT DOCUMENTS

FR 2931344 11/2009
WO WO2013/163810 11/2013
WO WO-2013163810 A1 * 11/2013 ..... A45D 33/006

*Primary Examiner* — Anthony D Stashick
*Assistant Examiner* — James M Van Buskirk
(74) *Attorney, Agent, or Firm* — CRGO Global; Steven M. Greenberg

(57) ABSTRACT

A cosmetic case includes a base, a cover and a closing/opening means, the base and the cover being hinged with respect to one another via a pivot connection, the case being capable of occupying two separate positions, a closed position wherein the cover is held in position on the base by the closing/opening means and an open position wherein the cover is free to pivot with respect to the base. The closing/opening means includes an additional part which is in slide connection or in pivot connection with the cover, and a locking means connected to the additional part—respectively to the base, the locking means being designed to each cooperate with a housing provided in/on the base—respectively in/on the additional part.

15 Claims, 7 Drawing Sheets

(56) References Cited

U.S. PATENT DOCUMENTS

2017/0020263 A1* 1/2017 Chang ..... A45D 33/003

* cited by examiner

CASE FOR COSMETIC PRODUCTS

CROSS-REFERENCE TO RELATED APPLICATIONS

This application claims priority under 35 U.S.C. 119(a) to French Patent Application No. 1757324, filed Jul. 31, 2017.

BACKGROUND OF THE INVENTION

Field of the Invention

The invention relates to a case for cosmetic products. Such cases usually include a tray for receiving cosmetic products and a cover to close or open the case. Thus, when the cover is in an open position, the user has access to the tray.

Description of the Related Art

Generally, cases for cosmetic products include a housing configured to receive the cosmetic product and a cover. The cover is conventionally closed by clipping or screwing. In the closed position, the cover protects the cosmetic product and the opening thereof enables the user to access the cosmetic product which is located in the housing.

In the case of cases closed by locking by a hook, for example, the opening is done conventionally by the intermediary of a pushbutton. This involves adding an additional, visible part which impacts the appearance of the case.

In addition, if comfort when using and an ease of opening is desired, the pushbutton must be of a sufficient size and the size of the case must thus be adapted.

Using a system of locking by pushbutton cannot therefore be considered for very thin cases. The thinness of the case would involve using a pushbutton that is too small to be easily handled and to enable the opening of the case.

Moreover, the size of the pushbutton impacts the locking force, thus a pushbutton that is too small would not enable to ensure a sufficient locking of the case.

There is therefore a need for a case for cosmetic products enabling to resolve the preceding disadvantages and which has a simple design that is easy to use.

BRIEF SUMMARY OF THE INVENTION

The present invention proposes a cosmetic case including a base, a cover and a closing/opening means. The base and the cover are hinged with respect to one another via a pivot connection. The case is capable of occupying two separate positions, a closed position wherein the cover is held in position on the base by the closing/opening means and an open position wherein the cover is free to pivot with respect to the base. The closing/opening means includes:

an additional part which is in slide connection or in pivot connection with the cover, a locking means connected to the additional part—respectively to the base, the locking means being designed so as to cooperate with a housing provided in/on the base—respectively in/on the additional part.

The actuation of the closing/opening means is done by the moving of the additional part with respect to the cover so as to engage/disengage the locking means of the housing.

The additional part is designed to make it inaccessible to touch almost all of the cover for an exterior user when the case is in the closed position, the part of the cover enabling it to pivot with respect to the base when the case is in the open position, referred to as hinging, being the only part of the cover accessible to touch for an exterior user when the case is in the closed position.

In other words, the case according to the invention can be opened by a single movement of an additional part with respect to the cover. Consequently, using a pushbutton is not necessary.

The size of the case is therefore no longer impacted by the presence of the pushbutton. It is possible to decrease the size of the case, in particular the thickness thereof, and to design a very thin case with an easy and effective opening.

In addition, with the cover being mainly inaccessible to the user, moving the additional part with respect to it is not impeded, even if the case is thin.

Moreover, the fact of using an additional part for the locking/unlocking of the case and of placing this part such that the cover is almost inaccessible to the user, enables not to obstruct the inner face of the cover and to arrange a mirror there, for example.

According to different embodiments of the invention, which can be taken together or separately:

- the connection between the additional part and the cover is ensured by a cooperation of technical forms present, over the one hand on the outer periphery of the cover, and on the other hand, over an inner circumference of the additional part,
- the cover includes at least one ridge configured to cooperate with a groove of the additional part;
- the cover includes at least one recess configured to locally give elasticity to the cover;
- the additional part is designed so as to surround the whole cover, except for the hinging,
- the case further includes an elastic means arranged between the additional part and the cover,
- the elastic means is arranged so as to hold the additional part and the cover in the relative configuration wherein they are located when the case is in the closed position, this whether the case is in the closed position or in the open position,
- the elastic means is a spring blade made of a flexible material,
- the spring blade is arranged between the outer periphery of the cover and the inner circumference of the additional part,
- the additional part is in pivot connection with the cover,
- the elastic means is a cam system protruding from the additional part—respectively from the cover,
- the cams are each gripped with a cam track made hollow on the surface of the cover respectively of the additional part,
- the case further includes a means for assisting the opening of the case,
- the assistance means are presented in the form of at least one material beading protruding from the base—respectively from the cover, in the direction of the cover—respectively of the base, next to the hinging,
- the means for assisting the opening of the case is intended to automatically remove the cover from the base during the passage of the case from closed position to the open position. This without the exterior user having to intervene,
- the locking means is a locking in one single point intended to cooperate with one single housing,
- the locking means is a multipoint locking,
- the locking points are regularly distributed over the inner circumference of the additional part—respectively over the periphery of the base—each being intended to cooperate with a dedicated housing, the locking means includes at least one hook having a technical form including a slope intended to facilitate the entry of the at least one hook in a respective housing during the passage from the open position to the close position of the case, means for blocking in position are arranged between the additional part and the cover to block the additional part relatively to the cover in the open position or in the closed position of the case;

the base is configured to receive a cosmetic product and/or a cosmetic product applicator, the cover is capable of receiving a mirror, preferably a pocket mirror type.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
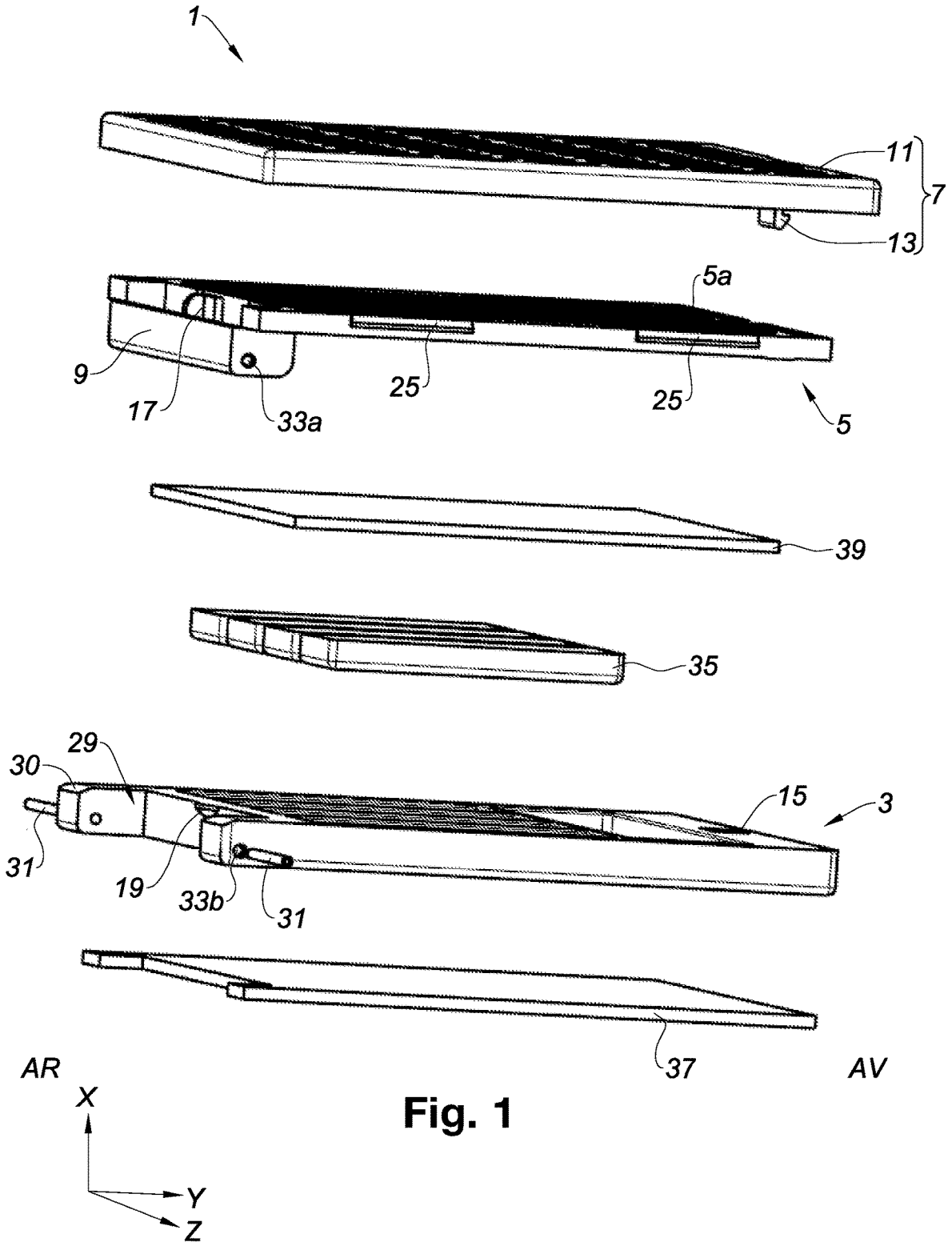
FIG. 1 is an exploded, perspective view of a first embodiment of a case for cosmetic products according to the invention.

The invention relates to a case 1 for cosmetic products including:

a base 3, a cover 5, and a closing/opening means 7.

In the description which will follow, the trihedral X, Y, Z is referred to, shown in different figures. The axis X is the main direction of longitudinal extension of the case 1, referred to a main direction, the axis Z is an axis orthogonal to the axis X and parallel to the plane defined by a bottom of the case 1 and parallel to the axis of rotation of the cover 5 and finally the axis Y is an axis orthogonal to the axes X and Z.

In a non-limitative manner, the terms "upper" and "top" or "lower" and "bottom" are used in reference to the axis X. The terms "interior" and "inner" are used with respect to the case 1 to name an element directed towards the centre of the case 1 or situated in the case 1 and the terms "exterior" and "outer" are used with respect to the case 1 to name an element directed towards the exterior of the case 1 or situated outside of the case 1. The terms "front" and "rear" are used in reference to the axis Y.

The base 3 and the cover 5 are hinged with respect to one another via a pivot connection.

The case 1 is capable of occupying at least two separate positions:

a closed position (that can be seen in FIGS. 2 and 7) wherein the cover 5 is held in position on the base 3 by the closing/opening means 7, and an open position (that can be seen in FIGS. 4, 5, 9, 10, 12 and 13) wherein the cover 5 is free to pivot with respect to the base 3.

The pivot connection is obtained by a part of the cover 5, referred to as hinging 9, enabling it to pivot with respect to the base 3 when the case 1 is in the open position.

The closing/opening means 7 includes:

an additional part 11 which is in slide connection or in pivot connection with the cover 5, and a locking means 13 connected to the additional part 11—respectively from the base 3, and designed so as to cooperate with a housing 15 provided in/on the base 3—respectively in/on the additional part 11.

Thus, the case 1 according to the invention has two main embodiments:

- a first main embodiment shown in FIGS. 1 to 5*d*, 12 and 14-16 wherein the additional part 11 is in slide connection with the cover 5,
- a second main embodiment shown in FIGS. 6 to 11 and 13 wherein the additional part 11 is in pivot connection with the cover 5.

Each one of the two main embodiments can have variants of embodiments. Subsequently, some of these variants will be defined.

The actuation of the closing/opening means 7 is done by the moving of the additional part 11 with respect to the cover 5 so as to engage/disengage the locking means 13 of the respective housing 15 thereof.

The additional part 11 is designed to make almost all of the cover 5 inaccessible to the touch of an exterior user when the case 1 is in the closed position, the hinging 9 being the only part of the cover 5 accessible to the touch for an exterior user when the case 1 is in the closed position.

In other words, the additional part 11 is designed so as to surround all of the cover 5, except for the hinging 9, this is what "almost all of the cover 5" means.

Thus, a case 1 is obtained wherein almost only the base 3 and the additional part 11 are accessible. This provides a pleasant and refined aesthetic appearance.

In addition, by preventing access from the cover 5 to the user in the closed position of the case 1, the user can easily move the additional part 11 with respect to the cover 5, without the movement being impeded by inadvertently holding the cover 5, for example.

This is particularly advantageous in the case of thin cases for which holding by the hand and moving only the additional part 11 can be difficult if the cover 5 is accessible. In other words, the case 1 can be opened by pushing on both the upper surface and on the edge of the additional part 11, or on the layer thereof.

Holding by the hand is thus easier and the movement is facilitated. The fingers of the user risk less sliding with respect to a system where the opening is done by a slide by pressing only on the upper surface of a part.

Moreover, the opening by moving the additional part 11 by the user enables to be able to apply a more significant force. In addition, the case 1 is less subject to soiling given the presence of the additional part.

The locking means 13 can be a locking in one single point, intended to cooperate with one single housing 15 or a multipoint locking.

Figure 12:
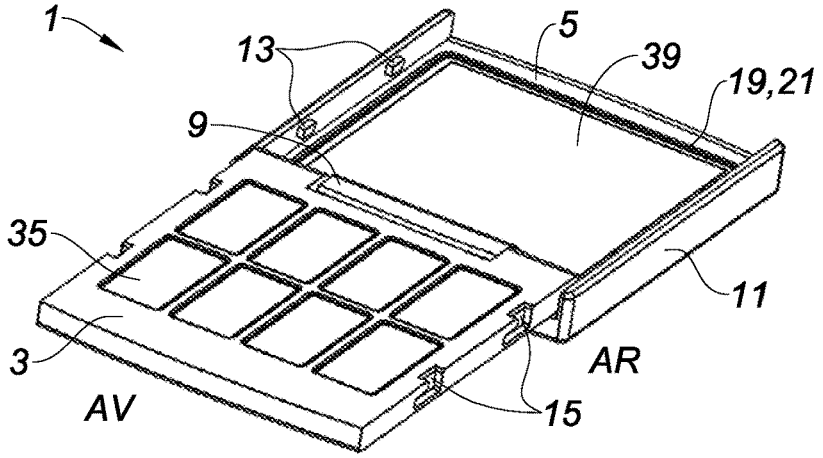
FIG. 12 is a perspective view of a variant of the first embodiment of a case for cosmetic products according to the invention, in the open position.
Figure 13:
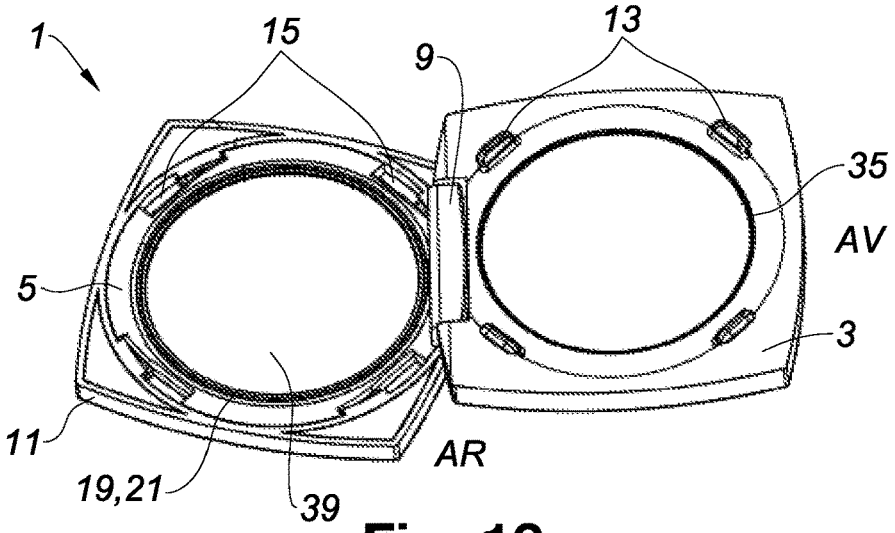
FIG. 13 is a perspective view of a variant of the second embodiment of a case for cosmetic products according to the invention, in the open position.

In the case of a multipoint locking, the locking points 13 are regularly distributed over the inner circumference of the additional part 11—respectively over the periphery of the base 3—each being intended to cooperate with a dedicated housing 15 (see FIGS. 12 and 13).

Figure 5:
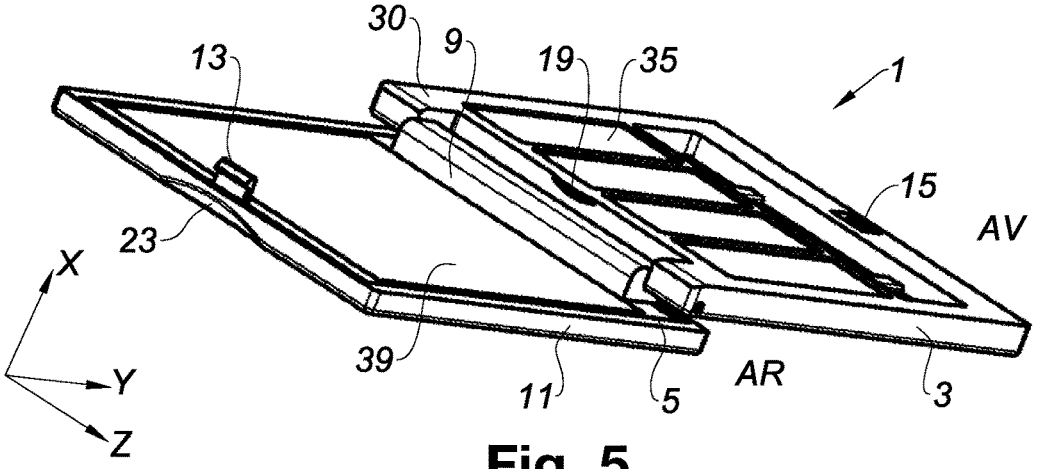
FIG. 5 is a perspective view of the case in the open position shown in FIG. 4.
Figure 10:
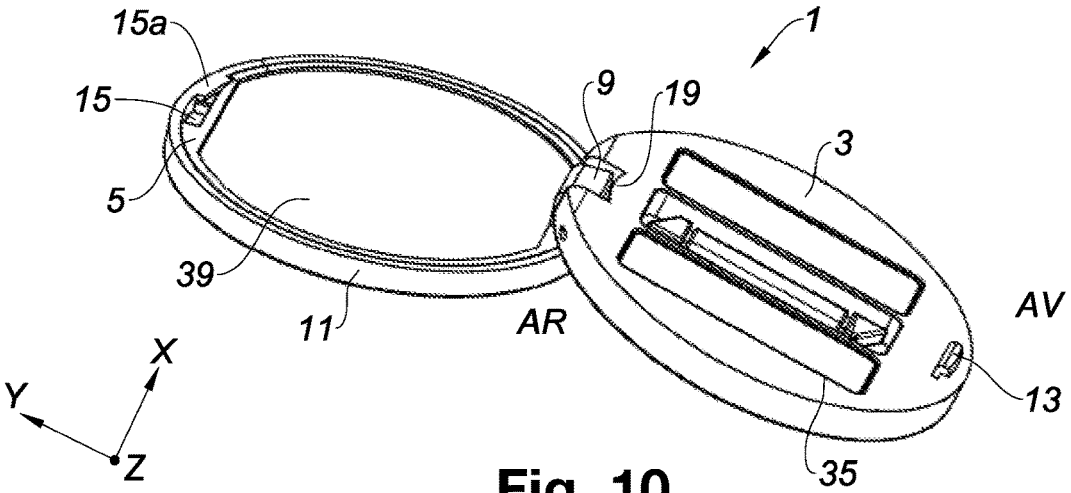
FIG. 10 is a perspective view of the case in the open position shown in FIG. 9.

Preferably, the housing 15 is provided in the base 3 or the additional part 11. The housing 15 is thus, for example, a cavity designed in the base 3 or the additional part 11 so as to retain the locking means 13 and hold the case 1 in the closed position (FIGS. 5 and 10).

The housing 15 can also be provided on the base 3 or the additional part 11 (not shown). The housing 15 is thus, for example, in the form of an embossed zone configured to receive the corresponding locking means 13 and retaining it engaged to hold the case 1 in the closed position. "Embossed" means a swelling, an element protruding from the base 3 or from the additional part 11, such as an embossed mould, a returned element (overmoulded, welded or glued) wherein a housing 15 is formed to receive the locking means 13.

The case 1 further includes an elastic return means 17 arranged between the additional part 11 and the cover 5. The elastic means 17 is arranged so as to hold the additional part 11 and the cover 5 in the relative configuration wherein they are located when the case 1 is in the closed position, this whether the case 1 is in the closed position or in the open position.

In other words, when the user moves the additional part 11 to disengage the locking means 13 and to open the case 1, once the cover 5 is open, the elastic means 17 enables the additional part 11 to go back by itself, to be returned automatically, into the position wherein it is located when the case 1 is in the closed position.

The elastic means 17 can be, for example, at least one spring blade (FIG. 5*a*), a cam system (FIG. 11), or any other device enabling the return of the additional part 11 into the position wherein it is located when the case 1 is in the closed position.

The elastic means 17 can be arranged between the outer periphery of the cover 5 and the inner circumference of the additional part 11, in particular on the front or on the rear of the case 1.

In other words, the elastic means 17 can be arranged between the outer edge of the rear (or front) side of the cover 5 and the inner circumference of the rear (or front) side of the additional part 11.

The elastic means 17 can also be arranged between an outer surface 5*a* of the cover 5 and an inner surface 11*a* of the additional part 11. The surface corresponds here to the surface delimited by the sides of the cover 5 or of the additional part 11, in other words, delimited by the periphery or the circumference of these parts.

The type of elastic means 17 is in particular chosen according to the shape of the case 1 and determines the arrangement of the elastic means 17.

Preferably, the spring blade 17 (FIG. 5*a*) is arranged between the outer periphery of the cover 5 and the inner circumference of the additional part 11. The cams 17*a* (FIG. 11) are arranged between the outer surface 5*a* of the cover 5 and the inner surface 11*a* of the additional part 11.

The spring blade 17 can be an element made of a flexible material, such as a material buffer inserted between the cover 5 and the additional part 11 or a thin blade made of flexible material.

"Flexible material" means a material which can be deformed when a pressure is exerted and goes back to the initial shape thereof when the pressure is no longer exerted.

It can be a thin blade made of thermoplastic materials, for example polypropylene (PP), polyethylene (PE), polyoxymethylene (POM), polybutylene terephthalate (PBT), acrylonitrile butadiene styrene (ABS), styrene acrylonitrile (SAN), styrene acrylonitrile/acrylonitrile butadiene styrene (SAN/ABS) or polycarbonate/acrylonitrile butadiene styrene (PC/ABS), or a buffer made of elastomer material.

Figure 5A:
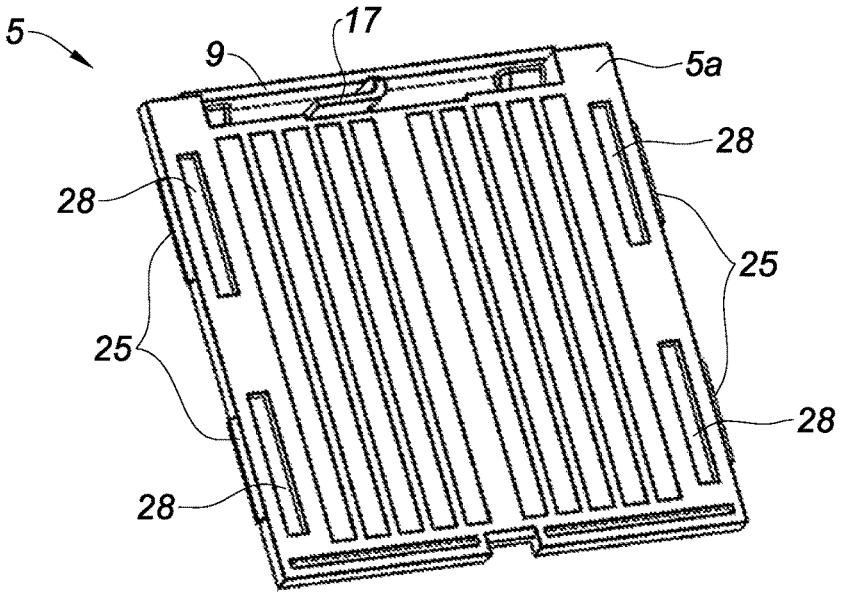
FIG. 5*a* is a perspective view from above of the cover in FIG. 1.
Figure 5B:
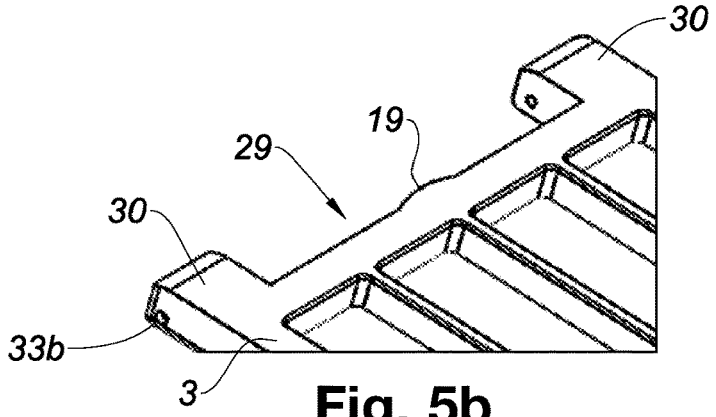
FIG. 5*b* is a detailed view of the base in FIG. 1.

The case 1 further includes a means 19 for assisting the opening of the case 1 (that can be seen in FIGS. 5 and 5*b*). Advantageously, the assistance means 19 can be presented in the form of at least one material beading protruding from the base 3—respectively from the cover 5, in the direction of the cover 5—respectively of the base 3, close to the hinging 9.

Figure 3:
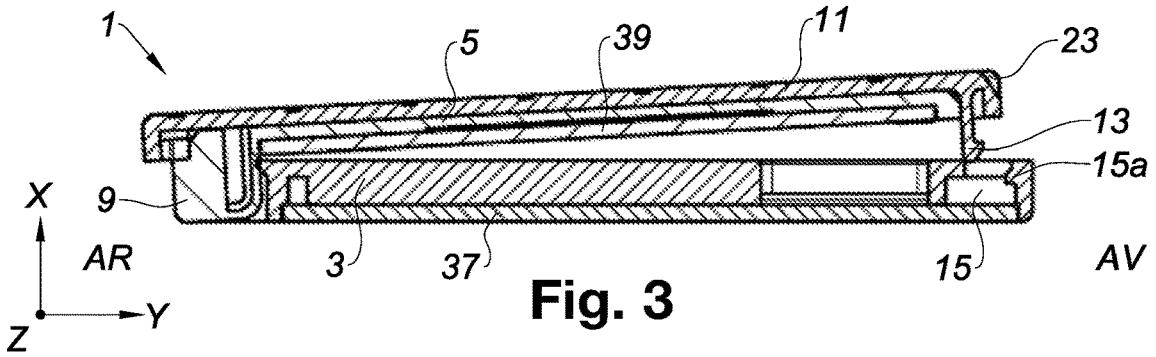
FIG. 3 is a longitudinal cross-section view of the case shown in FIG. 1, during opening.

The means 19 for assisting the opening of the case 1 is intended to remove the cover 5 from the base 3 during the passage of the case 1 from the closed position to the open position, while maintaining a preopening of a few degrees, for example, a preopening of between 0.5 and 5°, preferably 3° (position in FIG. 3).

Advantageously, as in the variants of embodiments in FIGS. 12 and 13, the case 1 can include a seal 21 provided on the surface of the base 3—respectively of the cover 5—so as to undergo a flattening by the cover 5—respectively by the base 3—when the case 1 is in the closed position.

As shown for example in FIGS. 12 and 13, in the case of a case 1 with a seal, the locking is preferably a multipoint locking such that this applies a sufficient pressure on the seal 21 when the case 1 is in the closed position, such that the sealing against impurities and fluids between the inner and outer environments of the case 1, in the closed position, is total under normal temperature and pressure conditions (NTPC), that is a temperature of 0° C. and a pressure of 1 atm.

Preferably, the passage from the open position to the closed position of the case 1, and conversely, does not provoke any friction on the seal 21. The seal 21 can be added to the surface of the base 3—conversely to the surface of the cover 5, held in position by surface gluing or overmoulded with the base 3—conversely with the cover 5. In certain variants, the seal 21 can be a means for assisting the opening of the case 1.

In the first embodiment shown in FIGS. 1 to 5*d* and according to the variants in FIGS. 12 and 14-16, the case 1 is of parallelepiped shape.

It includes a front side AV which could include, as here, a gripping zone 23 so as to facilitate the opening of the cover 5, a rear side AR on which is positioned the pivot connection and two opposite lateral sides, extending from the rear side AR to the front side AV.

A rectangular, square shape, or any other shape, for example mainly circular, could be considered.

In this first embodiment, the additional part 11 is in slide connection with the cover 5.

The slide connection between the additional part 11 and the cover 5 is ensured by a cooperation of technical forms present, on the one hand, over the outer periphery of the cover 5, and on the other hand, over an inner circumference of the additional part 11.

Figure 5C:
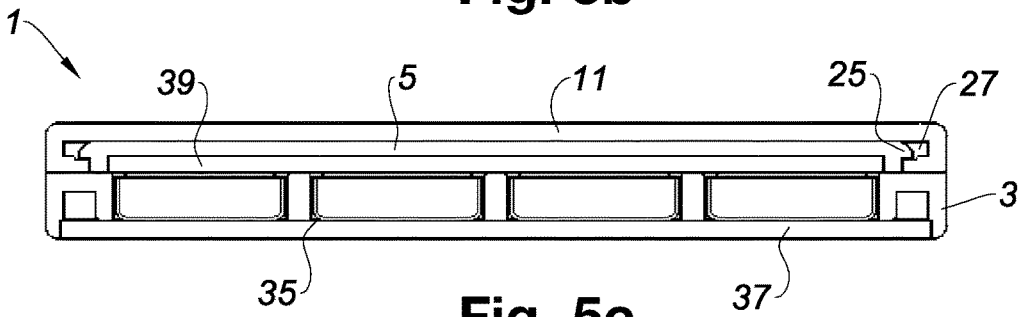
FIG. 5*c* is a cross-section, front view of the case shown in FIG. 1, in the closed position.
Figure 5D:
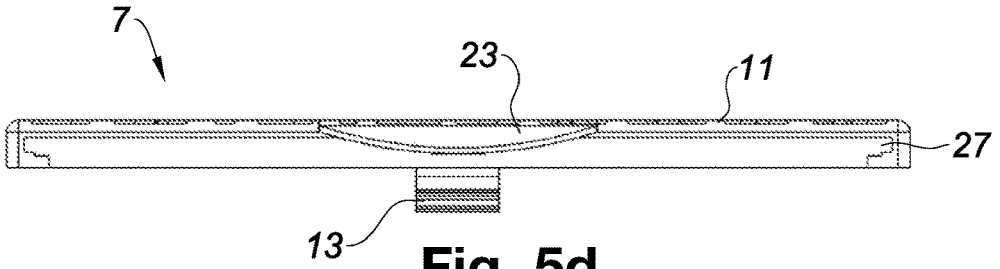
FIG. 5*d* is a front view of the additional part of the case shown in FIG. 1 with a partial cross-section view in the lower part to make the inside visible.

In this first embodiment, each one of the lateral sides of the cover 5 includes two ridges 25 configured to cooperate with a groove 27 extending over the whole length of each one of the lateral sides of the additional part 11 (FIGS. 5*c* and 5*d*).

In other words, the grooves 27 of the additional part 11 serve as slides to the ridges 25 of the cover 5, the additional part 11 being able to thus carry out a translational movement along the axis Y with respect to the cover 5.

This translational movement enables the actuation of the closing/opening means 7 and therefore engages/disengages the hooks 13 from the housing 15. To engage/disengage the hook 13 from the housing 15, the additional part 11 also carries out a translational movement with respect to the base 3.

The cover 5 can also include at least one recess 28 so as to make the part of the cover 5 which supports the ridges 25 flexible. This flexibility facilitates the assembly of the cover 5 in the additional part 11, in particular the assembly of the ridges 25 inside the grooves 27.

Preferably, the recess(es) 28 cross(es) and extend(s) over the part(s) of the cover 5 adjacent to the ridges 25.

In the embodiment shown in particular in FIG. 5*a*, the cover 5 includes four recesses 28. In other words, these recesses 28 give elasticity to the walls supporting the ridges 25 so as to facilitate the insertion, in particular by interlocking, preferably by clipping, of the part of the cover 5 inside the additional part 11.

In this embodiment, the hinging is situated on the rear side AR of the cover 5. It is a material extension, here in the form of a rectangular parallelepiped 9 being housed, during the assembly of the cover 5 to the base 3, in a housing 29 arranged behind the base 3 and formed between two extensions 30 of the base 3 situated towards the exterior of the case 1 (see FIG. 5*b*).

The material extension or hinging 9 is connected to the base 3 by the intermediary of at least one spindle 31 connecting the base 3 and the hinging 9 of the cover 5. Here, the hinging 9 includes two holes 33*a* situated on either side of the hinging 9 and the spindle corresponds to two pins 31.

Each one of the pins 31 has a first end inserted into one of the holes 33*a* of the hinging 9 and a second end inserted into a hole 33*b* formed on the rear side AR of the base 3 at the level of each one of the extensions 30. The pins 31 determine the axis of rotation of the cover 5, which is parallel to the axis Z. Any other means enabling to fulfil this function will be included in the invention.

In a variant of an embodiment not shown, it can also be devised that the only part of the cover 5 accessible to the touch for an exterior user when the case 1 is in the closed position, referred to as hinging 9, is two material extensions of the cover 5 situated towards the exterior of the case 1 on the rear side AR and forming a housing wherein an extension of the base 3 is placed, for example, in the form of a rectangular parallelepiped, or a cylinder, each one of the extensions of the cover 5 and of the base 3 being bored to make at least one pin 31 pass through to make the pivot connection between the base 3 and the cover 5. In other words, it is a system opposite to the one shown here.

In this first embodiment, the locking means 13 are connected to the additional part 11 and designed so as to cooperate with a housing 15 provided in the base 3.

In other variants of embodiments not shown, it can also be considered that the locking means 13 are connected to the base 3 and that the housing 15 is provided in the additional part 11. It can also be considered that the housing 15 is designed on the base 3 or the additional part 11, that is to say, supported by the base 3 or the additional part 11.

In the first variant of an embodiment shown in FIGS. 1 to 5*d*, the locking means 13 is a locking in one single point intended to cooperate with one single housing 15.

More specifically, it is a hook 13 are integrally formed with the additional part 11, that is to say, made from one single part, and which cooperates with a housing 15 designed in the base 3. The hook 13 and the housing 15 are situated on the front part AV of the case 1.

Preferably, the hook 13 is elastic. It can also have a technical form including a slope. These two characteristics enable to facilitate the entry of the hook 13 into the corresponding housing 15 during the passage from the open position to the closed position of the case 1.

"Elastic hook" means an element of which the free end is deformable, here along the axis Y, with respect to one part, here with respect to the additional part 11. Advantageously, the housing 15 has a protrusion 15*a* configured to retain the hook 13 and hold the case 1 in the closed position.

The hook 13 can also be overmoulded or returned onto the additional part or onto the base.

In this first embodiment, the elastic means 17 is a spring blade arranged to the rear AR of the case 1. It is a thin, plastic blade coming from material of the cover 5 (FIG. 1).

In this first embodiment, the means 19 for assisting the opening of the case 1 is a material beading protruding to the rear AR of the base 3 in the direction of the cover 5 close to the hinging 9, more specifically, at the level of the housing 29 receiving the hinging 9 of the cover 5 (FIGS. 1 and 5).

Figure 2:
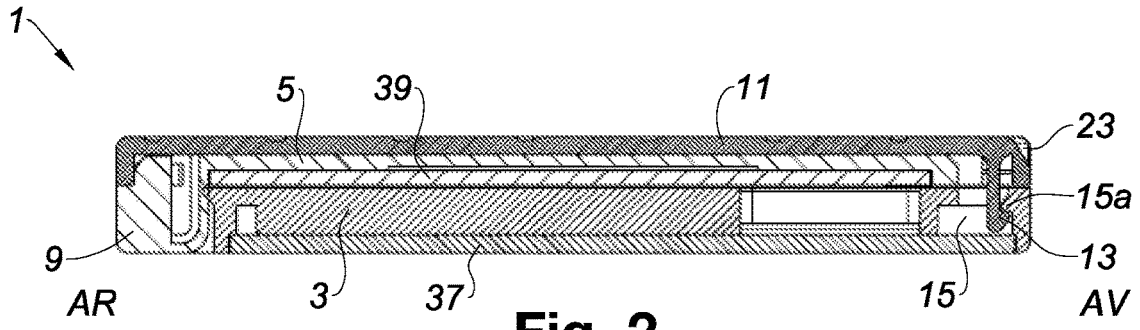
FIG. 2 is a longitudinal cross-section view of the case shown in FIG. 1, in the closed position.
Figure 4:
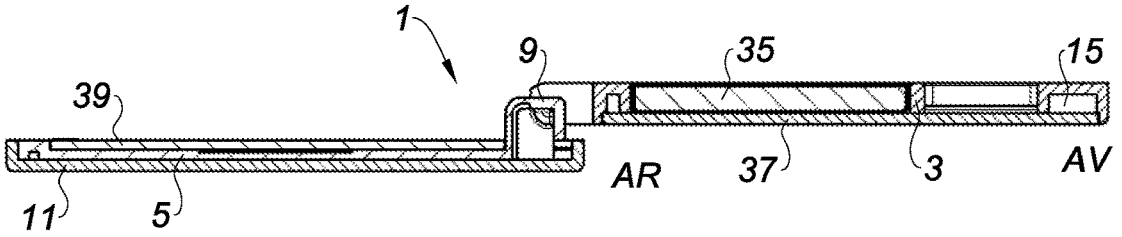
FIG. 4 is a longitudinal cross-section view of the case shown in FIG. 1, in the open position.

The opening mechanism of the case 1 according to the first embodiment will now be defined in reference to FIGS. 2 to 4.

Initially, the user releases the hooks 13 from the additional part 11 inserted in the housing 15 thereof provided on the base 3 by a translational movement along the axis Y of the additional part 11 with respect to the cover 5 and with respect to the base 3.

The hook 13 is thus released and the case 1 opens as can be seen in FIG. 3. The opening of the cover 5 is particularly facilitated by the presence of the beading 19 situated behind the base 3 which ensures a preopening of the case 1 by around 3°.

Simultaneously, the additional part 11 automatically returns in the initial position thereof, without the user needing to make an additional movement, thanks to the spring blade 17 situated behind the case 1 between the cover 5 and the additional part 11.

The user can finish the opening of the case 1 by pivoting the cover 5 assembled to the additional part 11 until the open position shown in FIG. 4.

In the second embodiment shown in FIGS. 6 to 11 and according to the variant in FIG. 13, the case 1, in particular the cover 5, is of a mainly circular shape.

It has a front part AV where the locking means 13 are located, and a rear part AR opposite, on which is positioned the pivot connection.

As for the first embodiment, a gripping zone (not shown) could be considered on the front part AV of the case 1. A parallelepiped shape, as for the first embodiment, could also be considered.

In this second embodiment, the additional part 11 is in pivot connection with the cover 5.

As for the slide connection of the first embodiment, the pivot connection between the additional part 11 and the cover 5 is ensured by a cooperation of technical forms present, on the one hand, over the outer periphery of the cover 5, and on the other hand, over an inner circumference of the additional part 11.

In this second embodiment, the inner circumference of the additional part 11 includes ridges 25, here four, of which two can be seen regularly angularly distributed and configured to cooperate with the grooves 27, here two, extending over the outer periphery of the cover 5 and regularly angularly distributed.

In a variant not shown, the inner circumference of the additional part 11 includes three ridges 25 configured to cooperate with three grooves 27.

Figure 6:
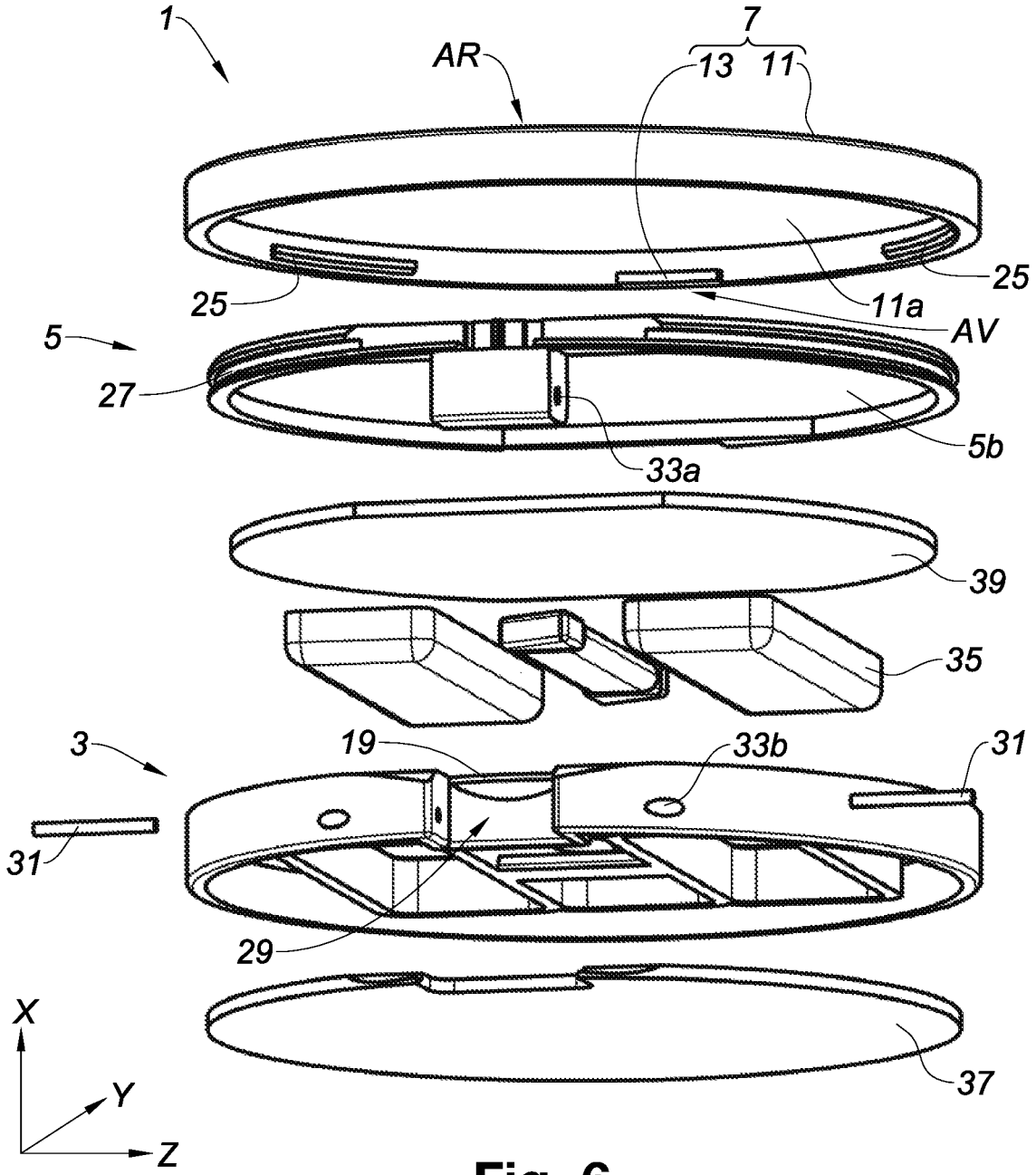
FIG. 6 is an exploded, perspective view of a second embodiment of a case for cosmetic products according to the invention.

In other words, the grooves 27 of the outer periphery of the cover 5 serve as a guiding path for the ridges 25 of the inner circumference of the additional part 11 (FIG. 6). The additional part 11 can thus be moved with respect to the cover 5 according to a rotation movement of axis parallel to the axis X. This rotation movement enables the actuation of the closing/opening means 7 and to engage/disengage the hook 13 from the housing 15.

The system enabling the pivot connection between the cover 5 and the base 3 is similar to that of the first embodiment. The hinging 9 of the cover 5 is connected to the base 3 by the intermediary of two pins 31 inserted into the holes 33*a*, 33*b* of the hinging 9 and of the base 3. The pins 31 determine the axis of rotation of the cover 5, which is parallel to the axis Z.

In the second embodiment shown in FIGS. 6 to 10, the locking means 13 is a locking in one single point connected to the base 3 and designed so as to cooperate with one single housing 15 provided in the additional part 11.

The locking means is a hook 13 extending along a direction parallel to the periphery of the case 1 and also has a slope facilitating the entry of the hook 13 into the corresponding housing 15 during the passage from the open position to the closed position of the case 1.

Advantageously, the housing 15 has a protrusion 15*a* configured to retain the hook 13 to hold the case 1 in the closed position.

This second embodiment can also include an elastic means. Preferably, it is a cam system protruding from the additional part 11—respectively from the cover 5. The cams are each gripped with a cam track 17*a* made hollow on the outer surface 5*a* of the cover 5—respectively on the inner surface 11*a* of the additional part 11.

Figure 11:
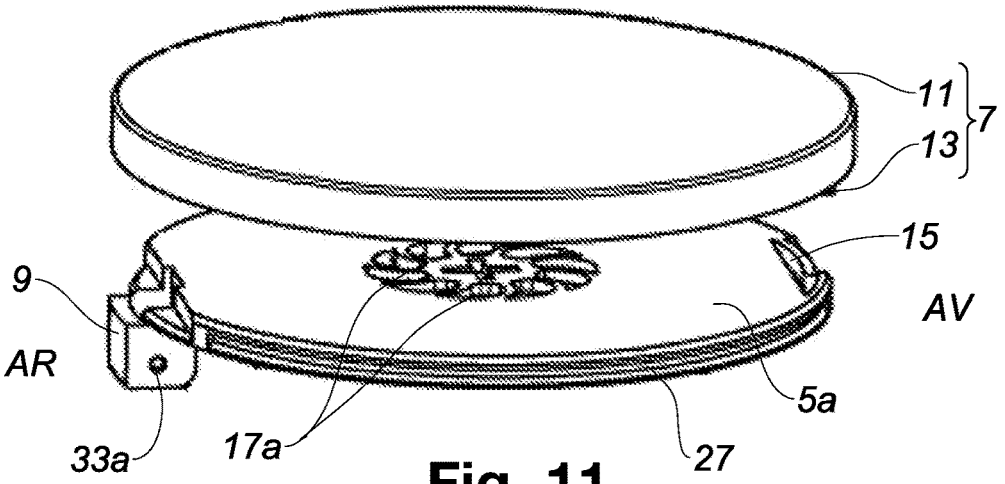
FIG. 11 is a perspective, exploded view of a part of a variant of the second embodiment of the case for cosmetic products according to the invention.

Such an elastic means 17 is shown in the variant in FIG. 11. In this variant, the cams (not visible) protrude from the additional part 11 and are each gripped with a cam track 17*a* made hollow on the outer surface 5*a* of the cover 5. It must also be noted that in this variant, the locking means 13 are similar to those of the first embodiment. It is a hook 13 connected to the additional part 11 and designed so as to cooperate with a housing 15 provided in the base 3 (not shown).

This second embodiment can also include a means for assisting the opening of the case 1, for example, in the form of a material beading 19, as shown here in FIGS. 6 and 10, protruding behind the base 3 in the direction of the cover 5 close to the hinging 9, as for the first embodiment.

Figure 7:
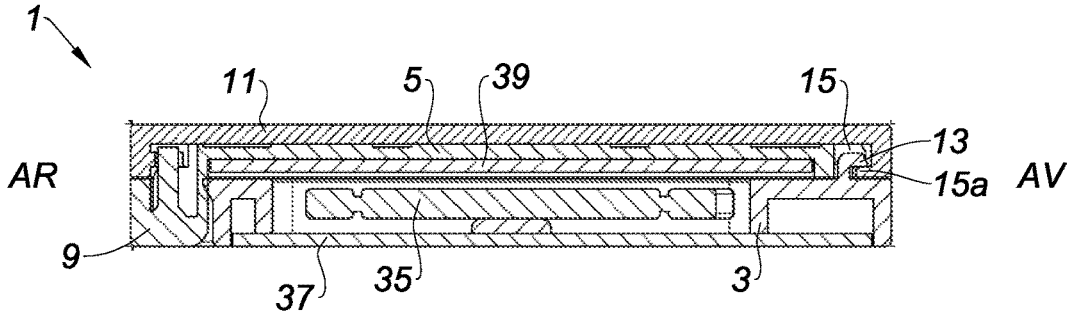
FIG. 7 is a longitudinal cross-section view of the case shown in FIG. 6, in the closed position.
Figure 8:
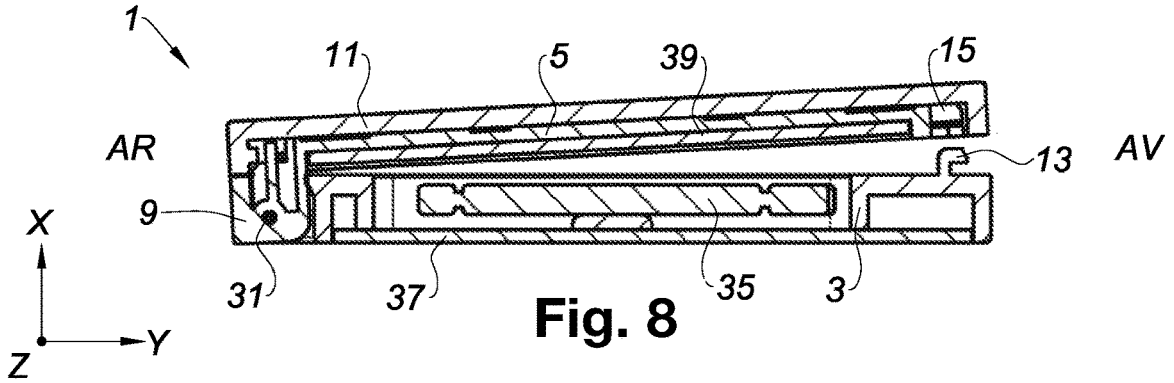
FIG. 8 is a longitudinal cross-section view of the case shown in FIG. 6, during opening.
Figure 9:
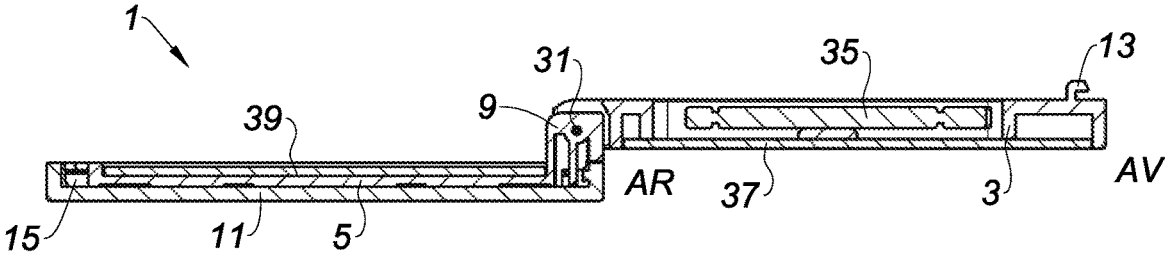
FIG. 9 is a longitudinal cross-section view of the case shown in FIG. 6, in the open position.

The opening mechanism of the second embodiment will now be defined in reference to FIGS. 7 to 9.

The opening mechanism is similar to that of the first embodiment, only the type of movement of the additional part 11 with respect to the cover 5 differs. Indeed, in the first embodiment, the movement is a translational movement along the axis Y whereas in this second embodiment, the additional part 11 makes a rotation movement with respect to the cover 5.

Initially, the user releases the hook 13 from the base 3 inserted in the corresponding housing 15 thereof provided on the additional part 11 by a rotation movement of axis parallel to the axis X of the additional part 11 with respect to the cover 5 and with respect to the base 3.

The hook 13 is thus released and the case 1 open as can be seen in FIG. 8. The opening of the cover 5 is particularly facilitated by the presence of the beading 19 situated behind the base 3 which ensures a preopening of the case 1 by around 3°. The user can then finish the opening of the case 1 by pivoting the cover 5 assembled to the additional part 11 up to the open position shown in FIG. 9

In this second embodiment, the case 1 does not include any elastic means, this involves the additional part 11 not automatically returning into the initial position thereof. The user must therefore make an additional rotation movement, in the direction opposite to that made to release the hook 13, in particular at the time of the closing of the cover 5 and of the locking to engage the hook 13 in the housing 15.

In the variants in FIGS. 12 and 13, the locking means 13 is a multipoint locking and the case 1 includes a seal 21.

The seal 21 is provided, here, on the surface of the cover 5 so as to undergo a flattening by the base 3 when the case 1 is in the closed position.

In these two variants, the seal 21 can advantageously play the role of means 19 for assisting the opening of the case 1. The seal is compressed when the case 1 is closed and it loosens when the locking means 13 are released thus making it possible to obtain a preopening of the case 1.

In the variant shown in FIG. 12, the multipoint locking is a set of four hooks 13 distributed two-by-two over the lateral sides of the additional part 11 cooperating with four housings 15 distributed two-by-two over the lateral sides of the base 3.

The housings 15 are L-shaped to enable the engagement of the corresponding hook 13 and the blocking thereof after movement of the additional part 11.

In the variant in FIG. 13, the cover 5 is of a circular shape and the additional part 11 has a mainly parallelepiped shape.

The additional part 11 is however in pivot connection with the cover 5 and the system for releasing the locking means 13 is similar to that of the second embodiment.

In this variant, the multipoint locking is a set of four hooks 13 regularly angularly distributed over the base 3 and cooperating with four housings 15 regularly angularly distributed over the additional part 11.

Advantageously, as shown in the different variants of embodiments of the two embodiments, the base 3 is intended to receive a cosmetic product and/or a cosmetic product applicator, for example, by the intermediary of at least one cup 35.

The base 3 can also include a separate bottom 37 as can be seen in FIGS. 1 and 6. The bottom 37 is attached to the base 3 by any suitable means, for example, by interlocking, clipping, screwing, welding or gluing. A separate bottom facilitates, in particular, the production of the base 3 by moulding, in particular in the case of plastic cases.

Advantageously, the cover 5 is capable of receiving a mirror 39 of the type pocket mirror. The mirror 39 is attached to the cover 5, in particular on the inner surface 5*b* of the cover 5, by any suitable means, for example by interlocking, clipping, screwing or gluing.

The user can thus apply make-up wherever they are, by looking in the mirror 39. Given the specific opening/closing system of the case 1, a mirror 39 can easily be affixed to the inner surface 5*b* of the cover 5.

Figure 14:
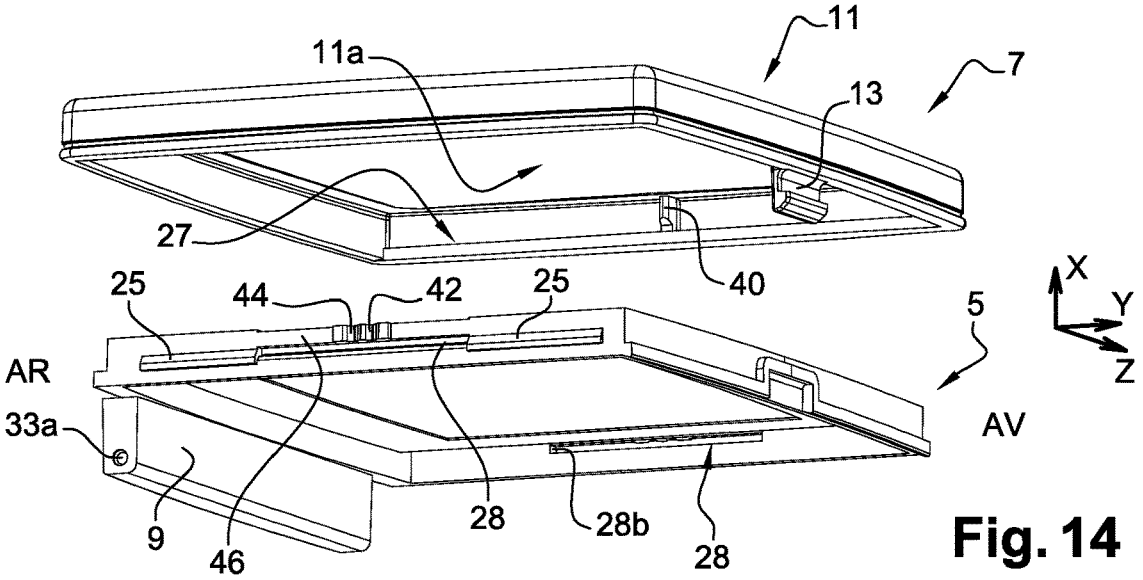
FIG. 14 is a perspective view which shows another variant of the first embodiment and which shows, in an exploded view, an additional part and a cover of a case for cosmetic products according to the invention.
Figure 15:
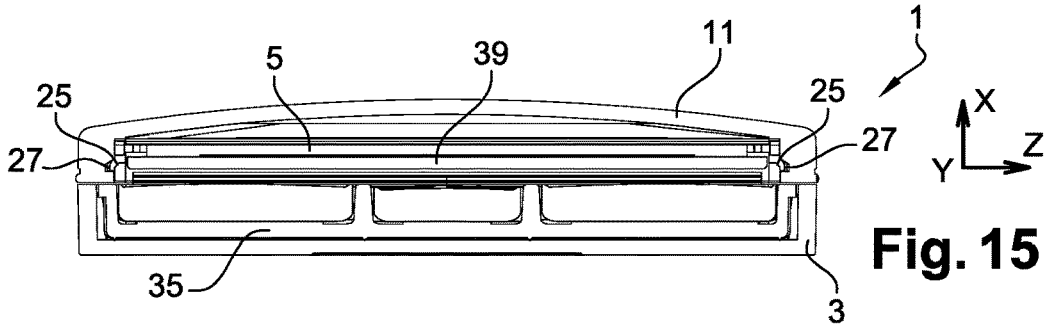
FIG. 15 is a cross-section, front view of the case further includes the additional part and the cover shown in FIG. 14.
Figure 16:
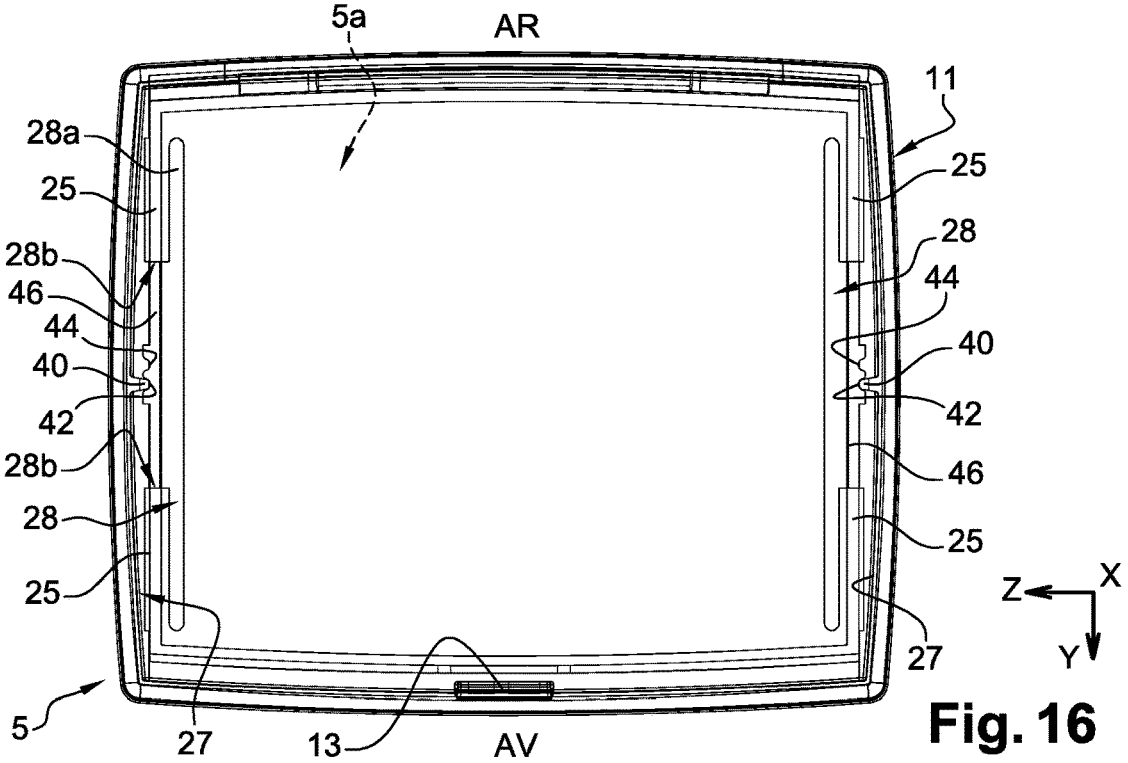
FIG. 16 is a top view which shows the additional part made transparent and the cover according to the variant in FIG. 14 and which further shows the blocking means by cooperation between each one of the fingers of the additional part with either of the two notches connected to the cover.

In FIGS. 14, 15 and 16, another variant of an embodiment has been shown of a case 1 according to a first embodiment shown in FIGS. 1 to 5*d*.

Below, by comparison, this other variant of an embodiment will be described such that the same references name the same parts, means, etc.

To make it simple, in FIG. 14, only the additional part 11 and the cover 5 have been shown, which, additionally, have in a non-limitative manner, a parallelepiped shape.

As in the first embodiment, the additional part 11 is in slide connection with the cover 5.

The case 1 includes a closing/opening means 7 formed by the additional part 11 and the locking means 13, the actuation of the closing/opening means 7 being done by moving the additional part 11 with respect to the cover 5 so as to engage or disengage the locking means 13 of the housing 15 (not shown) of the base 3.

The additional part 11 is configured to make it inaccessible to touch almost all of the cover 5 for an exterior user when the case 1 is in the closed position, the part of the cover 5 enabling it to pivot with respect to the base 3 when the case 1 is in the open position, referred to as hinging 9, being the only part of the cover 5 accessible to touch for an exterior user when the case 1 is in the closed position.

Preferably, the locking means 13 is a locking made of one single point by the intermediary of a hook.

Advantageously, the hook forming the locking means 13 is arranged at the front of the additional part 11 and made from material, in one single part, with the additional part 11.

In this variant of an embodiment in FIGS. 14 to 16, the case 1 does not include any elastic means 17 intended to ensure an automatic return of the additional part 11 and of the cover 5 into the relative configuration wherein the additional part 11 and the cover 5 are located when the case 1 is in the closed position, separately from the open or closed position of the case.

In this variant of an embodiment in FIGS. 14 to 16, the case 1 includes a means for assisting the opening of the case 1, in particular a beading 19 (not shown).

In addition, the case 1 does not include any seal 21.

The additional part 11 and the cover 5 are assembled so as to be able to slide against each other, that is to say, along the slide connection.

The slide connection between the additional part 11 and the cover 5 is ensured by a cooperation of present technical forms, on the one hand, over the outer periphery of the cover 5 and, on the other hand, over the inner circumference of the additional part 11. After assembly, the additional part 11 and the cover 5 form a single subassembly, a piece of equipment that can move in rotation relatively to the base 3.

As in the first embodiment (FIGS. 5*a*, 5*c* and 5*d*) and such as shown in this variant in FIGS. 14 to 16, each one of the outer lateral sides of the cover 5 includes two ridges 25 configured to cooperate with a groove 27 extending over all or part of the length of each one of the inner lateral sides of the additional part 11.

The grooves 27 of the additional part 11 constitute the slides wherein the ridges 25 of the cover 5 slide, the additional part 11 being assembled so that it can move following a translational movement along the axis Y with respect to the cover 5.

The translational movement along the axis Y enables the actuation of the closing/opening means 7 and more specifically, to engage/disengage the hook 13 from the housing 15. To engage/disengage the hook 13 from the housing 15, the additional part 11 also moves in translation with respect to the base 3.

The cover 5 includes at least one recess 28 so as to make the part of the cover 5 which supports the ridges 25 flexible. This flexibility facilitates the assembly of the cover 5 in the additional part 11, in particular the assembly of the ridges 25 inside the grooves 27.

Preferably, the recess(es) 28 cross(es) and extend(s) over the part(s) of the cover 5 adjacent to the ridges 25.

Such as shown in FIGS. 14 and 16, the cover 5 includes two recesses 28, that is a recess 28 on each lateral side respectively equipped with two ridges 25.

Each recess 28 includes a first part 28*a* made so as to cross in the upper face 5*a* of the cover 5 and which extends along the axis Y, preferably parallel to the side between the front and rear of the cover 5.

Each recess 28 includes a second part 28*b* which leads laterally to the wall of the side of the cover 5 and extends between the ridges 25.

The recesses 28 give elasticity to the walls supporting the ridges 25 so as to facilitate the insertion, in particular by interlocking, preferably by clipping, of the part of the cover 5 inside the additional part 11.

As in the first embodiment and although not visible in FIGS. 14 to 16, the cover 5 includes a hinging 9 which, situated on the rear side AR, is intended to be housed in an additional housing 29 arranged behind the base 3, between two extensions 30 of the base 3 situated towards the exterior of the case 1.

To form a hinge, the hinging 9 includes two holes 33*a* situated on either side of the hinging 9 and intended to receive at least one spindle, here a first end of two pins 31. The second end of each one of the pins 31 is received in a hole (not shown) formed on the rear side AR of the base 3. The cover 5 is thus connected to the base 3 of the case 1 by a pivot connection having an axis of rotation which is parallel to the axis Z.

Preferably, the bottom 37 is made of one single part, one-piece, with the base 3.

Such as shown in FIG. 15, the base 3 inside includes at least one cup 35 including one or more cavities intended to receive at least one cosmetic product and/or an applicator.

In the variant of an embodiment shown in FIGS. 14 to 16, the case 1 advantageously includes means for blocking in position the additional part 11 relatively to the cover 5.

The means for blocking in position are achieved by cooperation of shapes, for example between at least one blocking finger 40 intended to cooperate with at least one toothed portion.

Preferably, the means for blocking in position here include two blocking fingers 40 which are connected to the additional part 11, advantageously made of one single part with the additional part 11.

Such as shown in FIG. 14, each blocking finger 40 is arranged inside the additional part 11 and extends protruding along the axis Z from a lateral edge of the additional part 11, the blocking finger 40 being situated mainly in the middle between the front and the rear.

The cover 5 is equipped on each one of the lateral sides thereof with a toothed portion arranged mainly in the middle between the front and the rear of the cover 5, between each one of the ridges 25.

Each one of the toothed portions includes at least one first notch 42 and one second notch 44 which are respectively configured to cooperate with a blocking finger 40.

The first blocking notch 42 corresponds to the closed position of the case 1, in a locked state, that is to say, a configuration of the additional part 11 and of the cover 5 wherein the hook 13 is engaged in the housing 15 of the base 3 so as to lock the additional part 11 (and the cover 5) with the base 3 to prevent any opening.

The second blocking notch 44 corresponds to the open position of the case 1, at an unlocked state, that is to say, a configuration of the additional part 11 and of the cover 5 wherein the hook 13 is released from the housing 15 of the base 3 so as to unlock the additional part 11 with respect to the base 3 to enable an opening.

In the absence of any elastic return means 17, the cooperation between the blocking finger 40 and the first notch 42 shown in FIG. 16, advantageously enables to block the additional part 11 with respect to the cover 5 and this making avoid any random opening the case 1.

Advantageously, the second notch 44 enables the user to know that the case 1 is in the open position. During the opening of the case 1, the user acts on the additional part 11 to move it relatively to the cover 5 according to a translational movement from the front to the rear, the sliding of the additional part 11 being accompanied by a movement of the blocking finger 40 of the first blocking notch 42 up to the second blocking notch 44.

Preferably, the toothed portion including the first blocking notch 42 and the second blocking notch 44 is supported by a flexible part 46 of the cover 5, obtained thanks to the first part 28*a* and the second part 28*b* forming the recess 28.

Advantageously, the flexible part 46 of the cover 5 forming a beam is particularly likely to be deformed along the axis Z so as to facilitate the insertion along this same direction, such as the removal of the blocking finger 40 in each one of the first blocking notches 42 and second blocking notches 44.

Advantageously, the different parts are made of thermoplastic materials, for example, polypropylene (PP), polyethylene (PE), polyoxymethylene (POM), polybutylene terephthalate (PBT), acrylonitrile butadiene styrene (ABS), styrene acrylonitrile (SAN), styrene acrylonitrile/acrylonitrile butadiene styrene (SAN/ABS) or polycarbonate/acrylonitrile butadiene styrene (PC/ABS), preferably ABS, SAN/ABS or PC/ABS which are materials that have a more aesthetic finish.

Advantageously, the seal is made of elastomer, such as rubber, silicone, expanded polyethylene, such as Tresylene® or any other material enabling the guarantee the sealing of the case.

To achieve the additional advantageous effects, the variants of embodiments can be combined without moving away from the scope of the invention.

In the cosmetic case according to the invention, the conventional locking, in particular by pushbutton, is replaced by a difference in force to be exerted.

The user activates the locking manually and thus the pushbutton system can be avoided. More freedom in the design of the case is possible.

A very thin cosmetic case can thus be considered, with a very refined design, without any visible locking/unlocking element.

In addition, it can be provided to integrate the additional elements at the level of the cover, such as a mirror, given that the opening is triggered by moving an additional part surrounding the cover. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

What is claimed is:

1. A cosmetic case comprising a base, a cover and a closing/opening means, the base and the cover being hinged with respect to one another via a pivot connection, the case being capable of occupying two separate positions, a closed position wherein the cover is held in position on the base by the closing/opening means and an open position wherein the cover is free to pivot with respect to the base, said closing/opening means comprising:

an additional part which is only in slide connection with the cover, a locking means connected to the additional part respectively to the base, said locking means being designed so as to cooperate with a housing provided in/on the base respectively in/on the additional part, the actuation of the closing/opening means being done by moving the additional part with respect to the cover so as to engage/disengage the locking means of said housing, the additional part being designed to make almost all of the cover inaccessible to the touch of an exterior user when the case is in the closed position, the part of the cover enabling it to pivot with respect to the base when the case is in the open position, referred to as hinging, being the only part of the cover accessible to the touch for an exterior user when the case is in the closed position.

2. The case according to claim 1, wherein the connection between the additional part and the cover is ensured by a cooperation of technical forms present, on the one hand, over the outer periphery of the cover and, on the other hand, over an inner circumference of the additional part.

3. The case according to claim 1, wherein the cover comprises at least one ridge configured to cooperate with a groove of the additional part.

4. The case according to claim 1, wherein the cover comprises at least one recess configured to locally give elasticity to the cover.

5. The case according to claim 1, wherein the additional part is designed so as to surround all of the cover, except for said hinging.

6. The case according to claim 1, further comprising an elastic means arranged between the additional part and the cover, said elastic means being arranged so as to maintain the additional part and the cover in the relative configuration wherein they are located when the case is in the closed position, this whether the case is in the closed position or in the open position.

7. The case according to claim 6, wherein the elastic means is a spring blade made of flexible material, said spring blade being arranged between the outer periphery of the cover and the inner circumference of the additional part.

8. The case according to claim 6, wherein, when the additional part is in pivot connection with the cover, the elastic means is a cam system protruding from the additional part respectively from the cover said cams each being gripped with a cam track made hollow on the surface of the cover—respectively of the additional part.

9. The case according to claim 1, further comprises a means for assisting the opening of the case after actuation of the opening means, said assistance means being presented in the form of at least one material beading protruding from the base—respectively from the cover, in the direction of the cover—respectively of the base, close to said hinging, said means for assisting the opening of the case ensuring a preopening of the case by automatically removing the cover from the base during the passage of the case from the closed position to the open position.

10. The case according to claim 1, wherein the locking means is a locking in one single point intended to cooperate with one single housing.

11. The case according to claim 1, wherein the locking means is a multipoint locking, said locking points being regularly distributed over the inner circumference of the additional part—respectively over the periphery of the base—each being intended to cooperate with a dedicated housing.

12. The case according to claim 1, wherein the locking means comprises at least one hook having a technical form comprising a slope intended to facilitate the entry of said at least one hook into a respective housing during the passage from the open position to the closed position of the case.

13. The case according to claim 1, wherein the means for blocking in position are arranged between the additional part and the cover to block the additional part relatively to the cover in the open position or in the closed position of the case.

14. The case according to claim 1, wherein the base is configured to receive a cosmetic product and/or a cosmetic product applicator.

15. The case according to claim 1, wherein the cover is capable of receiving a mirror of the type pocket mirror.

* * * * *